United States Patent [19]

Primerano et al.

[11] 4,311,209

[45] Jan. 19, 1982

[54] STEPLADDERS

[76] Inventors: Eugenio Primerano; Rita Pieri in Primerano, both of Via Ettore Franceschini, 109 Roma, Italy

[21] Appl. No.: 7,600

[22] Filed: Jan. 29, 1979

[30] Foreign Application Priority Data

Feb. 6, 1978 [IT] Italy ..... 47927 A/78
Jan. 17, 1979 [IT] Italy ..... 47675 A/79

[51] Int. Cl.[3] ..... E06C 1/36

[52] U.S. Cl. ..... 182/206; 182/93; 182/107

[58] Field of Search ..... 182/206, 93, 82, 214, 182/229, 107

[56] References Cited

U.S. PATENT DOCUMENTS

| | | | |
|---|---|---|---|
| 659,814 | 10/1900 | Frizell | 182/206 |
| 774,009 | 11/1904 | Wandel | 182/206 |
| 843,989 | 2/1907 | Bauer | 182/214 |
| 2,088,895 | 8/1937 | Connell | 182/206 |
| 2,815,160 | 12/1957 | Gilmour | 182/214 |
| 3,476,211 | 11/1969 | Cormier | 182/22 |
| 3,590,951 | 7/1971 | Berger | 182/206 |
| 3,603,431 | 9/1971 | Nameche | 182/206 |
| 3,712,419 | 1/1973 | O'Hara | 182/206 |

*Primary Examiner*—Reinaldo P. Machado
*Attorney, Agent, or Firm*—Finnegan, Henderson, Farabow, Garrett and Dunner

[57] ABSTRACT

A step-ladder is provided with one or more hooks on one or both of the ladder's stanchions, with the hooks adapted to engage with corresponding horizontal, standing, or inclined members carried by a fixed structure. The hooks, which may also be telescopic, are vertically and perpendicularly displaceable with respect to the normal position of the step-ladder and each hook is independent from the other in order to permit their regulation or adjustment in height and direction of orientation.

18 Claims, 19 Drawing Figures

Fig. 5
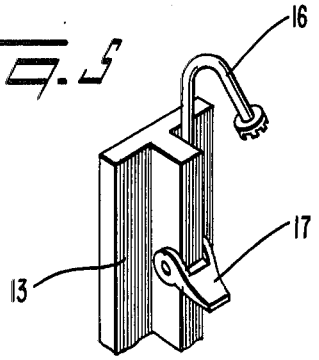
Fig. 6
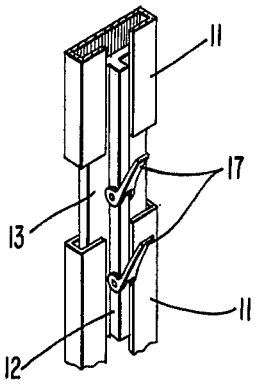
Fig. 7
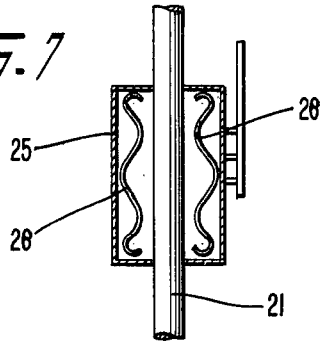
Fig. 7'
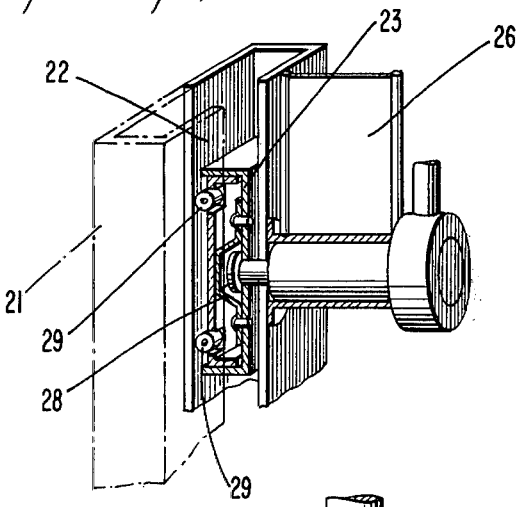
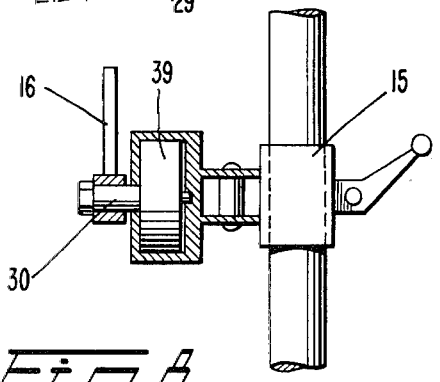
Fig. 8
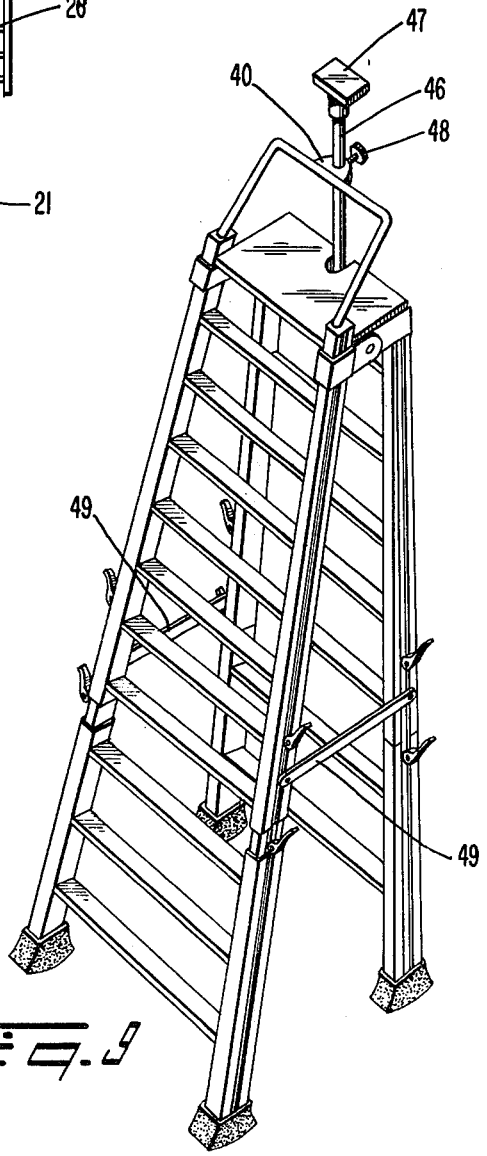
Fig. 9

Fig. 10
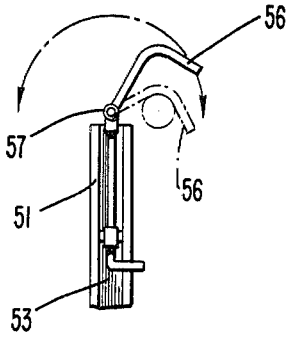
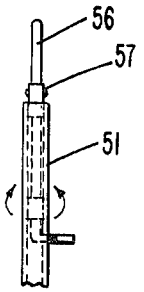
Fig. 10'
Fig. 11
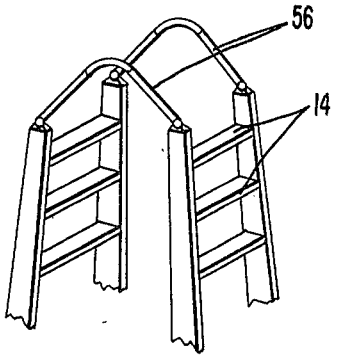
Fig. 12
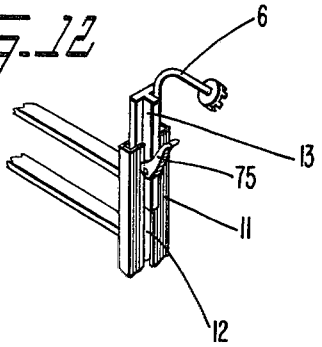
Fig. 13
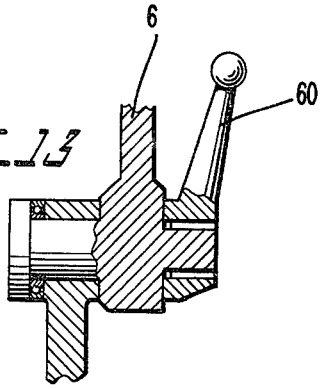
Fig. 14
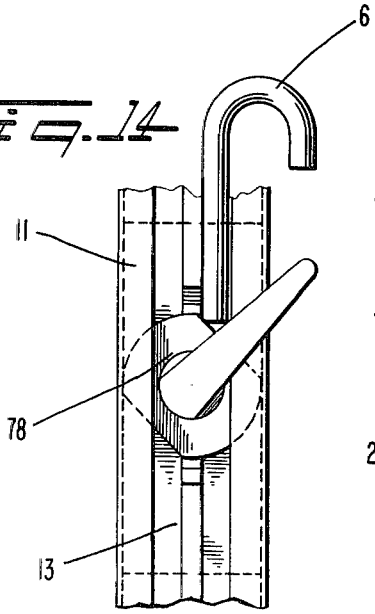
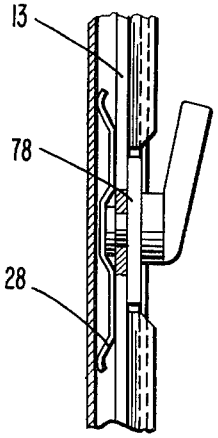
Fig. 16
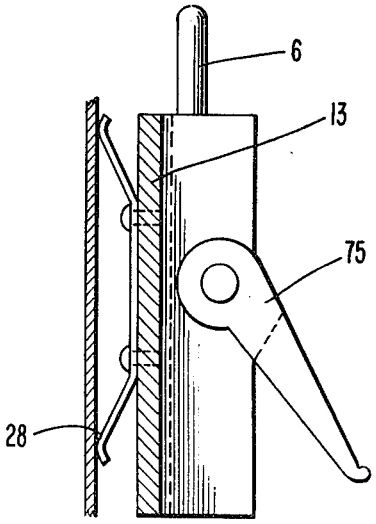
Fig. 15

STEPLADDERS

It is known that in very frequent cases it is necessary to employ (step) ladders which are leant against a surface in order to reach a prefixed height.

It is known as well that these ladders are normally composed of two stanchions and a series of steps interposed between the stanchions, and that they are supported in an upright position by means of the upper ends of the stanchions or by means of a hinged frame.

Many artifices have been devised and realized in order to prevent slipping of stepladders along the floor, and in some cases also stepladders have been realized which are provided, at the upper end, with a fixed hook, in order to be anchored to a properly arranged shelf or ground beam. The various improvements made in stepladders have, however, left substantially unchanged the stepladder in respect to its original structure or construction, since no adjustable member has been foreseen which allows for the stepladder to be effectively anchored to a stanchion or to any ground beam. Therefore, the stability of a stepladder is determined by the bearing angle created by the ladder itself between the floor and the fixed structure against which the ladder is placed.

Furthermore, prescribed regulations relating to accident prevention during work require, among other things, that the hand-ladders, both simple and of the portable type, during use, must be provided with an anchoring device or with holding hooks at the upper end of the stanchions, which are adapted to prevent banking (side skid) and the slipping of stepladders. A danger of side skipping or sliding of ladders is always present and exists both in the building yards and in other places or premises, wherein the ladders or similar tools are employed. Normally, and not always, a leaning ladder is secured to a supporting member by means of various ties which, however, do not solve the problem, since, whenever the ladder must be displaced from one position and transferred to another position, these ties or bonds must be untied and, as a practical matter, very often they are not restored.

An object of the present invention is to provide improvements, by means of which the stepladders themselves, in conformity with safety law regulations, are in condition to be suitably anchored to a supporting member.

Another object is to optionally prevent undesired opening of stepladders through the interposition of optional intermediate supports.

According to the present invention, a hook is foreseen which is preferably mounted on a stanchion or onto each of the stanchions of the stepladder, said hook being bound, or able to be bound, on one side to the stepladder, and on the other side to the bearing surface.

The appended drawings, in a purely schematic way, provide some examples of embodiments of the improvements of the present invention. In particular:

FIG. 1 shows a stepladder provided with a hooking system according to the invention;

FIGS. 2, 3 and 3' show a modification of the embodiment of FIG. 1;

FIGS. 4, 5 and 6 show, in a schematical view, a clamping system of the hook or bonding member;

FIGS. 7 and 7' show in detailed form some blocking systems of the hook to the stanchion, which may be grooved or not;

FIG. 8 shows another variant or modification of the improvements of the present invention;

FIG. 9 shows the stepladder improved according to the invention, in another variant which permits the anchoring of the stepladder; and FIGS. 10 to 16 show, in view and in section, some blocking systems for the hook intended for connection with the stanchion.

Figure 1:
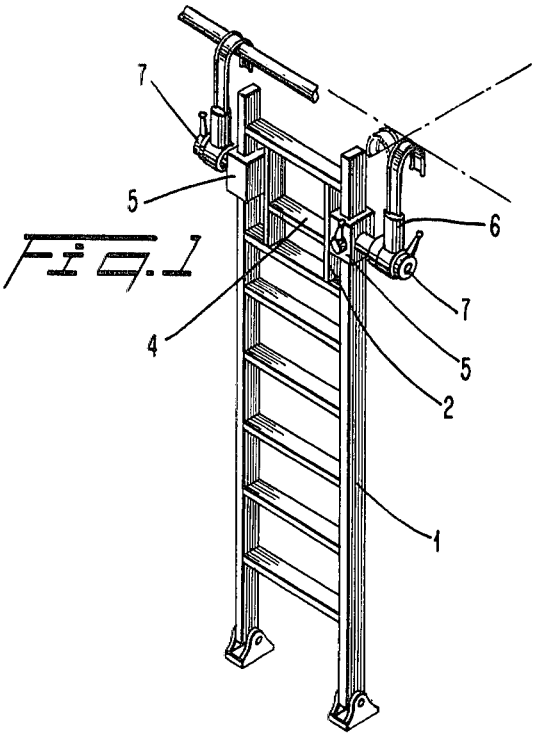

With reference to said drawing, and in particular to FIG. 1, on the stanchions 1 of the ladder, toward the upper end of the stepladder itself, and positioned inwards, are supports or bridges 2 which carry one or more steps 4 having a reduced size. Onto one of the stanchions 1 or onto both the stanchions 1, it is possible to apply a sliding sleeve 5, carrying a suitable hook 6. This sliding sleeve, provided with suitable locking means, such as a handle with an eccentric 7, a setscrew or other means, surrounds the portion of the stanchion 1 which is left free from the steps 4 as a consequence of the small bridges 2. It follows, therefore, that the sleeve 5, with a corresponding hook, is able to slide along a certain stretch or distance, so that it may fit the various heights of the bearing surface, heights which usually vary between very restricted limits.

It is to be pointed out that, given the existence of the small bridges 2, the steps 4 in the portion which is delimitated by said small bridges, are shorter, but this does not influence the utilization of the ladder.

In order to prevent the possible drawback derived from the employment of the small bridges or supports 2, the preferred solution has been foreseen, this solution being represented in the FIGS. 2, 4, 5 and 6.

In this embodiment, the stanchions of the ladder are formed by box-type elements 11, preferably "□"-shaped, having internal surfaces which receive steps 14, which are fixed to them in any suitable manner. The box-type elements 11 are suitably open on one of the three external residual surfaces, i.e. on the wall which is opposed to that on which the steps are fixed, or else on the lesser size walls. Obviously, the preferred solution is that of a slit 12 on each of the stanchions, on the face which is external with respect to the face on which the steps are fixed. Within the section element (channel) forming the stanchion 11 of the stepladder, a plate 13 is adapted to slide (FIGS. 4, 5, 6) which is provided with an optional elastic friction member and with optional rollers (FIG. 7') and carries a hook 16 similar to the hook 6 illustrated in the embodiment of FIG. 1, said hook projecting or exiting through the slit 12 of the stanchion. As it can be seen from the drawings, the hook 16 is able to slide, with its plate 13, along the whole length of the stanchion 11, reaching, therefore, a chosen position whichever to bind the ladder to a ground beam or to any horizontal member, and to be locked in position by means of eccentrics 17. If the hook 16 is suitably orientable (i.e. revolving), the stepladder can also be anchored to a vertical element or any non-horizontal member carried by the bearing surface, for instance by a framework upon which the stepladder is leant. It is obvious that, in this manner, it is possible to achieve the anchorage of the stepladder at any convenient height whatsoever, and, therefore, the utilization of a so improved stepladder is extremely wide.

Figure 3:
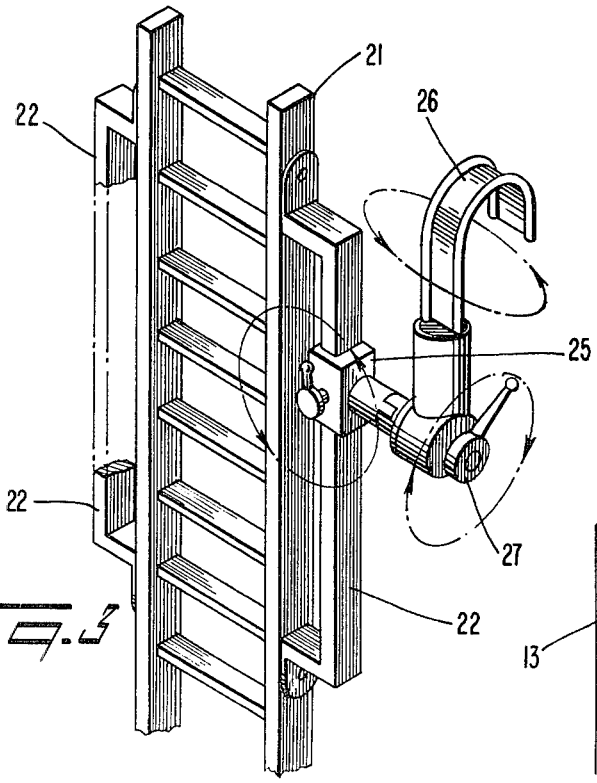
Figure 3:
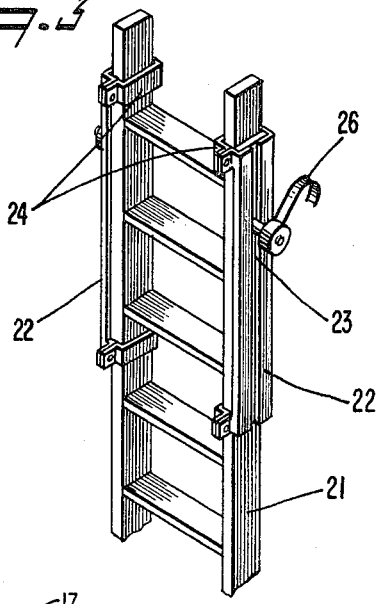
Figure 4:
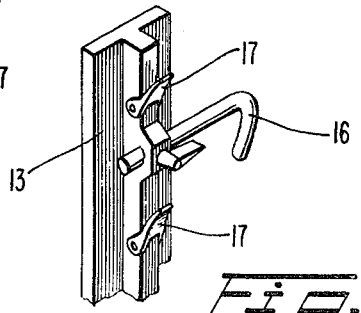

In a further variant of the described embodiment, and precisely in the modification illustrated in the FIGS. 3 and 3', the stanchion of the stepladder 21 is provided with a support or small bridge 22, on which a sleeve 25 is able to slide. Sleeve 25 is optionally adapted to be fixed in position, for instance by means of a setscrew. Sleeve 25 can have a tubular or box-like shape, carrying a hook 26. The support 22 may be fixed to one or to each of the stanchions 21 (FIG. 3), or else it may be fixable to them (FIG. 3') for instance by means of collars 24. The small bridge 22 may, on the other hand, form the body upon which the sleeve 25 slides (FIG. 3) or else may form the body within which a plate 23 slides (FIG. 3'), the one or the other carrying a hook 26. Sleeve 25 and plate 23 are optionally blockable into position by means of a suitable blocking member 27, which may be similar, for instance, to the handle with eccentric 7 which has been mentioned with reference to FIG. 1.

As it may be understood from FIG. 7, the sleeve 25 is provided with elastic elements 28 which, while they are kept fixed to the sleeve 25 at any suitable point, are, at the same time, free to bend, so that they exert a pressure upon the small bridge 22, or else against the internal surface of the stanchions 21, creating, therefore, a friction against the sliding of the sleeve 25 itself.

In the modification which is illustrated in FIG. 7', the plate 23, in addition to being provided with the elastic member 28, is provided with rollers 29 which work as support to keep the movement of 26 free, in order to permit a more easy control or regulation of the vertical position of the hook 26 itself. It is very clear, in any case, that, with hook 26 being orientatable with respect to the sleeve 25 or to the plate 23, the hooking of the stepladder could take place also on a non-horizontal member. The hooks 26 may, furthermore, be oriented in such a way to be arranged parallel to the plane of the ladder.

As it is schematically indicated in FIG. 8, the hook 16 may be mounted upon an axis 30, bound by means of a spring, for instance a spiral spring 39, to the sleeve 15 or to a plate such as plate 13 or plate 23. By a solution of this kind it is possible to bind the hook 16 to the ladder in such a way that it will press constantly against the ground beam or the portion of the framework, in general, to which the stepladder is secured.

In FIG. 9 a system is illustrated which permits anchoring conventional double stepladders to a fixed structure. Said system is composed of a bushing 40 having a supporting function, and within which a stanchion 46 is able to slide which, at its top end, carries a flat body 47 in order to achieve the contact with the fixed structure.

Said stanchion 46 may have various geometrical shapes, as for instance tubular, round, square, rectangular, "C"-shape and so on, and generally has a length which is equal to that of the stepladder, values larger or lesser than those of the step-ladder being not excluded. The stanchion 46, intended for anchoring or contact, is able to slide within the bushing 40, until it achieves a contact in open ladder conditions, with an upper fixed structure, which generally is the ceiling of the premises wherein the step-ladder is employed.

Once the step-ladder has been opened and the stanchion 46 has been positioned until it achieves a contact or abutment against the fixed structure, (this operation may take place manually or with the help of a mechanical device), the stanchion itself comes to be sturdily fixed at the desired position and at any desired height. The clamping system of the butting stanchion may be realized with a setscrew 48, or by means of an eccentric device, or with a mechanical stop member, and so on. The step-ladder, now, is no longer displaceable and, thus, skiddings and slidings are prevented, as well as falls or reversals of the step-ladder itself.

A step-ladder in such a way conceived and designed, is particularly useful in connection with building (wall) work, painting work in general, and various household uses, and has the main purpose of assuring effective safety and anchoring which is required by the regulations actually in force for accident prevention.

In FIGS. 10 and 10' another type of anchoring hook is illustrated. Said hook, indicated at 56, is similar to the hooks 6, 16 and 26, but it is provided with an articulated joint 57, which allows the rotation of the hook itself from a position almost in axis with the plate 53 up to a position of maximum clamping, as it is shown in FIG. 10 by dashed lines. If the hooks, orientatable as already said or as now illustrated in FIGS. 10 and 10', of two opposing ladders are turned each toward the other, it will be possible to achieve a connection of the two ladders (FIG. 11), so that a "book-type" ladder is obtained. Since as mentioned, the hooks may be employed also as spacers, suitably arranging other hooks at convenient heights of the stanchions, by means of them, the foreseen and necessary safety brackets will be obtained, as indicated at 49 in FIG. 9.

Particular care, in relation to the utilization of the stepladder of the present invention, has been devoted to the clamping systems of the hooks at the desired height.

As previously mentioned, the hooks, which for simplicity sake have been indicated by 6 in the FIGS. 12 to 16, are carried by a sleeve 5 as in the FIG. 1, or 25 as in FIG. 3, or preferably by a plate 13 which slides within the recess or hollow portion of the stanchion 1. Said plate 13 is provided with a guide which runs within the slit or groove 12 of the stanchion 11, so that the plate itself takes, in cross-section, the shape of a "T". At a suitable point of the web of the "T" member, an eccentric system is positioned (FIGS. 12–16) which, according to its position, blocks the plate 13 against the inner surface of the stanchion 11, or leaves it free to slide. Therefore, it is extremely easy to regulate the position of the hook 6 which may be provided, at its own end, with an elastic buffer in order to improve the adhesion of the hook to a flat surface.

As it can be seen in FIGS. 1–3 and 13, the solution, indicated in the preceding Figures, adopted for the locking of the hook to the stanchion, may be achieved also by means of a handwheel 60 which exerts a traction upon the web of the hook 6, so that the hook 6 itself, by the effect of the rotation of the handwheel 60, is in condition to be locked at various desired positions.

FIGS. 14, 15 and 16 show some details of the embodiments of the locking system which has been illustrated in the preceding Figures, and prove the extreme simplicity and ease of operation presented by the locking system. We obtain, that is, a stepladder which presents extremely remarkable safety and, at the same time, versatility to be adapted to various types of use. In particular, the elastic member 28 facilitates the positioning of the plate 13, and therefore of the hook 6, until there is engagement of the locking member, which may be the eccentric 75 of FIG. 16, the handwheel 60 of FIG. 13, or the eccentric 78 of FIGS. 14 and 15 which locks the "T" plate 13, acting against the sides of the stanchion 11.

Furthermore, it is to be pointed out that the stepladders utilizing the improvements of the invention will preferably have steps which are obtained according to a profile with ribs, evenly added, and of a different material which prevent the user's foot from slipping on the step itself, and the stanchions will be provided with antislip feet.

In any case, the basic concept of the invention is that of providing ladders, both new types and those already operating, with movable anchoring or holding means, which permit the ladders to meet the accident-preventing law regulations.

Figure 2:
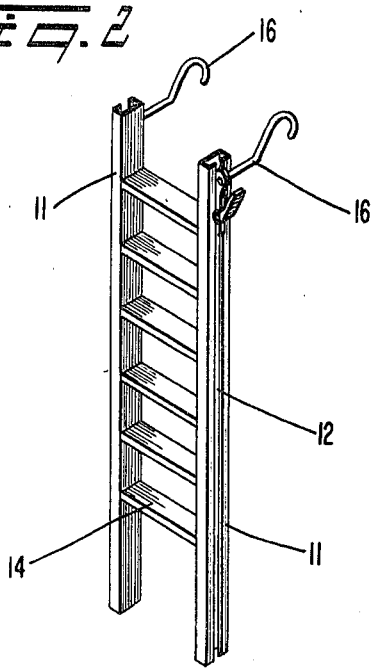

In effect, the devices of the FIGS. 1, 3 and 3' may be applied both to the existing stepladders and to stepladders of novel construction, while the solution of FIG. 2 refers substantially to the last-named ones.

It is also to be understood that the hooks on the two stanchions of a stepladder may stay and be fixed at different heights and, if orientable, with different angles of inclination, in such a way to allow the hooking of the stepladder to support members which are differently situated and/or oriented. Finally, it is important to remark that the sleeves 5 and 25 or the plate 13, 23 and 53 with the corresponding hooks, instead of being carried by the stanchion, may be carried, fixed or removable, by a step 4, and in this way it is possible to centrally fix a hook to the stepladder.

Furthermore, the plates 13, 23 and 53 may carry means to fix them into position, as shown in the FIGS. 6 and 9, in such way to permit the mounting, "by the head," of two or more stepladders, upper stanchions being reciprocally fixed to underlying ones and the upper ones thereby constituting an extension of the ladder. The anchoring system with the hooks as shown are positioned at least on the upper section of an extensible ladder, with one or two of the hooks being adapted to serve, if arranged as an extension of the ladder, as a handle, as prescribed by the law regulations.

As is manifest from the preceding description, the improvements of the present invention are particularly interesting for all those step-ladders which have very frequent use and, by reason of their destination itself, are intended to work in equilibrium conditions which not always are extremely satisfactory. Such a situation takes place not only in urban dwelling houses, but also and above all in shops, building yards, in agriculture, in boats or ships, in execution of electric plants and/or telephone and/or railway plants, in painting works and in ceiling and wall plastering works and, as already said, above all in the building of, and accessing to, various structures.

The improvements of the present invention have been illustrated and described in a purely exemplary, nonlimitative way. It is obvious that they admit all those modifications of a constructional order which may be suggested by the techniques and the practical fulfilment, without, however, being beyond the scope of the invention, as it appears from the appended claims.

We claim:

1. In a ladder having steps and having primary stanchions for supporting said steps, the improvement comprising:

(a) at least one hook adapted to engage a supporting structure;

(b) means for mounting said hook to said ladder to permit selective sliding of said hook longitudinally along said ladder beyond the intersection of at least one of said steps and a primary stanchions, wherein said means for mounting further permits rotation of said hook around an axis parallel to the longitudinal axis of said ladder; and (c) means for selectively locking said hook in more than one longitudinal position along said ladder.

2. The ladder of claim 1 wherein said means for mounting further permits rotation of said hook about an axis parallel to the axes of said steps.

3. In a ladder having steps and having primary stanchions for supporting said steps, the improvement comprising:

(a) at least one hook adapted to engage a supporting structure;

(b) means for mounting said hook to said ladder to permit selective sliding of said hook longitudinally along said ladder beyond the intersection of at least one of said steps and a primary stanchion, wherein said means for mounting said hook comprises a support mounted on one of said stanchions and located parallel to the longitudinal axis of said ladder and outside the boundary of said ladder as defined by the stanchions and steps, and said means for mounting further comprises a sleeve slidably mounted on said support, said sleeve supporting said hook; and (c) means for selectively locking said hook in more than one longitudinal position along said ladder.

4. In a ladder having steps and having primary stanchions for supporting said steps, the improvement comprising:

(a) at least one hook adapted to engage a supporting structure;

(b) a plate adapted to slide longitudinally within one of said stanchions;

(c) a slot running longitudinally along said one of said stanchions to provide access to said plate;

(d) means extending through said slot for mounting said hook to said plate; and (e) means for selectively locking said plate to said one of said stanchions.

5. The ladder of claim 4 wherein said ladder comprises two stanchions and each of said stanchions has associated with it at least one of said hooks, plate, slot means for mounting, and means for locking.

6. The ladder of claim 4 wherein said means for mounting permits rotation of said hook around an axis parallel longitudinal to the axes of said steps.

7. The ladder of claim 6 wherein said means for locking further includes means for holding said hook in more than one rotational position.

8. The ladder of either claims 4 or 7 wherein said means for mounting further permits rotation of said hook around an axis parallel to the longitudinal axis of said ladder.

9. The ladder of claim 4 wherein said slot causes said stanchion to have a "C"-shaped cross-section and said plate in combination with said means for mounting has a "T"-shaped cross-section.

10. The ladder of claim 9 wherein said means for locking comprises an eccentric coupled to said web of said "T"-shaped cross-section to selectively lock said hook to said one of said stanchions.

11. In a ladder having primary steps and having a pair of primary stanchions for supporting said primary steps, the improvements comprising:

(a) at least one hook adapted to engage a supporting structure;

(b) at least one secondary step of lesser width than said primary steps;

(c) secondary stanchions positioned within the boundary of said ladder as defined by said primary stanchions and positioned adjacent but separated from a selected portion of said primary stanchions to support said secondary steps;

(d) at least one sleeve slidably mounted on said selected portion of said primary stanchions;

(e) means for mounting said hook to said sleeve; and (f) means for selectively locking said sleeve to said selected portion of said primary stanchions.

12. The ladder of claim 11 wherein said means for mounting permits rotation of said hooks around an axis parallel to the longitudinal axes of said primary steps.

13. The ladder of either claims 11 or 12 wherein said means for mounting further permits rotation of said hook around an axis parallel to the longitudinal axes of said ladder.

14. The ladder of claim 13 wherein said means for locking further includes means for holding said hook in more than one rotational position.

15. The ladder of claim 12 or 3 wherein said means for mounting includes a spring which is deformed by rotation of said hook.

16. The ladder of claim 4, 11, 1, 2 or 3 further comprising an adjustable anchoring strut extending longitudinally from the upper end of said ladder to hold said ladder firmly into a selected position.

17. The ladder of claim 4, 11, 1, 2 or 3 wherein said ladder includes a second separate set of steps and primary stanchions supporting said steps, said primary stanchions each having a "C"-shaped cross-section at least at the ends thereof and at least one pair of members "T"-shaped in cross-section and sized to slide into the ends of said primary stanchions, said members having anchoring means to hold said members into place to thereby enable said second set of steps and primary stanchions to form an extension of said ladder.

18. The ladder of claim 16 wherein said ladder includes a second separate set of steps and primary stanchions supporting said steps with each of said primary stanchions and said secondary stanchions including a slit; said second set of stanchions being at one end thereof coupled respectively to one end of said primary stanchions of said ladder in "book-fashion;" and said ladder further including tie rods having ends tied to said primary stanchions and said second set of stanchions, respectively, through said slits to provide rigidity to said ladder.

* * * * *